US010987926B2

(12) United States Patent
Chapman et al.

(10) Patent No.: US 10,987,926 B2
(45) Date of Patent: Apr. 27, 2021

(54) CONTINUOUS INKJET PRINTERS

(71) Applicant: Domino UK Limited, Cambridge (GB)

(72) Inventors: Christopher Adrian Chapman, Cambridge (GB); Steven Andrew Martin Fenton, Cambridge (GB); Daniel John Lee, Huntingdon (GB); Jonathan Morgan, Cambridge (GB)

(73) Assignee: Domino UK Limited

( * ) Notice: Subject to any disclaimer, the term of this patent is extended or adjusted under 35 U.S.C. 154(b) by 0 days.

(21) Appl. No.: 16/341,532

(22) PCT Filed: Oct. 16, 2017

(86) PCT No.: PCT/GB2017/053118
§ 371 (c)(1),
(2) Date: Apr. 12, 2019

(87) PCT Pub. No.: WO2018/069733
PCT Pub. Date: Apr. 19, 2018

(65) Prior Publication Data

US 2019/0366712 A1 Dec. 5, 2019

(30) Foreign Application Priority Data

Oct. 14, 2016 (GB) ..... 1617490

(51) Int. Cl.
*B41J 29/38* (2006.01)
*B41J 2/115* (2006.01)

(52) U.S. Cl.
CPC ..... *B41J 2/115* (2013.01)

(58) Field of Classification Search
None
See application file for complete search history.

(56) References Cited

U.S. PATENT DOCUMENTS

| | | | | | |
|---|---|---|---|---|---|
| 3,750,191 | A * | 7/1973 | Naylor, III | B41J 2/115 | 347/80 |
| 3,769,632 | A | 10/1973 | Julisburger et al. | | |
| 3,999,188 | A * | 12/1976 | Yamada | B41J 2/115 | 347/80 |
| 4,329,695 | A * | 5/1982 | Aiba | B41J 2/115 | 347/76 |
| 4,344,078 | A | 8/1982 | Houston | | |
| 5,646,663 | A * | 7/1997 | Clark | B41J 2/025 | 347/73 |
| 2005/0280676 | A1* | 12/2005 | Rybicki | B41J 2/125 | 347/76 |
| 2006/0049511 | A1* | 3/2006 | Schaefer | H01L 24/05 | 257/700 |
| 2015/0153689 | A1* | 6/2015 | Russel | G03G 15/657 | 399/68 |

FOREIGN PATENT DOCUMENTS

| | | | | |
|---|---|---|---|---|
| EP | 1847391 | A1 | 10/2007 | |
| EP | 1944163 | A1 * | 7/2008 | B41J 2/125 |
| WO | 2005023549 | A1 | 3/2005 | |
| WO | 2012107560 | A1 | 8/2012 | |

* cited by examiner

*Primary Examiner* — Erica S Lin
*Assistant Examiner* — Tracey M McMillion
(74) *Attorney, Agent, or Firm* — Price Heneveld LLP

(57) ABSTRACT

The invention describes a number of methods and apparatus for shortening the inter-message gap on a continuous inkjet printer. Included is a novel phase testing methodology.

4 Claims, 4 Drawing Sheets

| Starting position | Actual best position | Range of pass positions | First test position | Second test position | Third test position | Test results | Action | Set point | Set point within one place from best position? | Set point in a pass position? | Set point closer than start position? |
|---|---|---|---|---|---|---|---|---|---|---|---|
| 9 | 9 | 5-12 | 11 | 13 | 12 | PFP | -3 | 9 | Y | Y | Y |
| 9 | 8 | 4-11 | 11 | 13 | 12 | PFF | -4 | 8 | Y | Y | Y |
| 9 | 7 | 3-10 | 11 | 10 | 12 | FPF | -5 | 7 | Y | Y | Y |
| 9 | 6 | 2-9 | 11 | 10 | 9 | FFP | -3 | 6 | Y | Y | Y |
| 9 | 5 | 1-8 | 11 | 10 | 9 | FFF | -6 | 3 | N | Y | Y |
| 9 | 4 | 0-7 | 11 | 10 | 9 | FFF | -6 | 3 | Y | Y | Y |
| 9 | 3 | 15-6 | 11 | 10 | 9 | FFF | -6 | 3 | Y | Y | Y |
| 9 | 2 | 14-5 | 11 | 10 | 9 | FFF | -6 | 3 | Y | Y | Y |
| 9 | 1 | 13-4 | 11 | 10 | 9 | FFF | -6 | 3 | N | Y | Y |
| 9 | 0 | 12-3 | 11 | 10 | 9 | FFF | -6 | 3 | N | Y | Y |
| 9 | 15 | 11-2 | 11 | 13 | 15 | PPP | 4 | 13 | N | Y | Y |
| 9 | 14 | 10-1 | 11 | 13 | 15 | PPP | 4 | 13 | Y | Y | Y |
| 9 | 13 | 9-0 | 11 | 13 | 15 | PPP | 4 | 13 | Y | Y | Y |
| 9 | 12 | 8-15 | 11 | 13 | 15 | PPP | 4 | 13 | Y | Y | Y |
| 9 | 11 | 7-14 | 11 | 13 | 15 | PPF | -5 | 10 | Y | Y | Y |
| 9 | 10 | 6-13 | 11 | 13 | 15 | PPF | -5 | 10 | Y | Y | Y |

*FIG. 5*

CONTINUOUS INKJET PRINTERS

FIELD OF THE INVENTION

This invention relates to a continuous inkjet (CIJ) printer and, in particular, to the charging of droplets in a CIJ printer.

BACKGROUND TO THE INVENTION

CIJ printers are widely used to place identification codes on products passing along production lines and thus typically print at the high speeds dictated by the speeds of those lines.

A commonly encountered CIJ printer includes a printer housing that contains a system for pressurising ink. Once pressurised, part of the ink flow is directed, via an ink feed line housed in a conduit, to a printhead. At the printhead the pressurised ink is passed through a nozzle to form an ink jet. In the known manner, a vibration or perturbation is applied to the ink jet causing the jet to break into a stream of droplets.

The device used to apply the perturbation is known as a droplet generator and typically contains a transducer driven at a required frequency by a sinusoidal electrical signal running at the same frequency. The electrical signal is commonly termed the modulation signal.

Downstream of the droplet generator, the printer includes a charge electrode to charge selected droplets, and an electrostatic facility to deflect the charged droplets away from their original trajectory and onto a substrate. By controlling the amount of charge that is placed on droplets, the trajectories of those droplets can be controlled to form a printed image.

A CIJ printer is so termed because the printer forms a continuous stream of droplets irrespective of whether or not any particular droplet is to be used to print. The printer selects the droplets to be used for printing by applying a charge to those droplets, unprinted droplets being allowed to continue, on the same trajectory as they were jetted from the nozzle, into a catcher or gutter. The unprinted droplets collected in the gutter are returned from the printhead to the printer housing via a gutter line included in the same conduit as contains the pressurised ink feed line feeding ink to the printhead. Ink, together with entrained air, is generally returned to the printer housing under vacuum. That vacuum may be generated by a pump in the gutter line or by a vacuum source located further along the ink circulation system.

In order to produce a good print quality a continuous inkjet printer needs to charge the ink droplets accurately. As well as selecting and applying the right electrical potential to the charge electrode, it is also required to synchronise the application of charge voltage with the point at which the jet of ink breaks into droplets, a point known as the 'break-up' point. The precise position of the break-up point changes slightly over time in response to various system variables such as temperature, ink viscosity, ink pressure etc. Generally, as these variables are well controlled, the change in movement of the droplet is also small and within the scale of the distance between ink droplets in the stream.

As the change in position is less than a droplet separation, in the process for synchronising the charging of a droplet with the droplet formation the printer needs only to determine the phase relationship between the modulation signal and the drop-charging signal. The process of controlling this synchronisation is commonly known as 'phasing' and is achieved by testing the amount of charge transferred to a droplet or group of droplets for a range of phase positions, the feedback of this being via a phase sensor. Phasing is well known to those versed in the CIJ art and a detailed description of an example of phasing can be found in EP 0 386 049.

Phasing normally takes place between every print undertaken by a CIJ printer and it is well understood that the tests required to determine the correct phase for charging take a finite time to perform. This can present a problem during the use of a CIJ printer because, as described above, these printers are used for printing on high speed production lines where the products may be spaced closely together. In this situation the so called inter-message gap i.e. the time between successive prints is only about a millisecond which compromises the ability of the printer to effect proper phase testing.

It is an object of this invention to provide methods and/or apparatus relating to a CIJ printer that will go at least some way in addressing the above-mentioned problem; or which will at least provide a novel and useful choice.

SUMMARY OF THE INVENTION

In one aspect the invention provides a method of controlling a continuous inkjet printer configured to execute prints, and to undertake phase tests for a droplet generator and charge electrode of the printer, said method being characterized in that individual measures that combine to provide a phase test for the droplet generator and charge electrode are undertaken between successive prints.

In a second aspect the invention provides a continuous inkjet printer comprising a droplet generator and a charge electrode and operable to undertake phase tests for the droplet generator and charge electrode, wherein the printer is operable during intervals between printing operations to undertake subsets of a set of measures that constitute a phase test for the droplet generator and charge electrode and to undertake the phase test using results of the subsets of the set of measures obtained during at least two intervals between printing operations.

Typically the printer is operable to undertake the subsets of the set of measures between messages printed by the printer, one message typically being printed on each product transported down a production line.

However it is envisaged that where the speed of a production line is low enough to permit this, the printer may advantageously be operable to undertake the subsets of the set of measures between strokes printed by the printer, a message typically being printed by printing a plurality of strokes.

In a third aspect the invention provides a method of reducing the inter-message gap in a continuous inkjet printer configured to execute prints and to undertake phase testing between prints, said method comprising dividing a phase test into a number of measures, at least some of said measures being performed between different prints.

In a fourth aspect the invention provides a method of shortening an inter-message gap in a continuous inkjet printer configured to execute prints with gaps there-between and to undertake phase testing between said prints, said printer having a first stage amplifier and a second stage amplifier configured to amplify charges measured during phase testing, said method comprising switching out at least one of said amplifiers when said printer is not undertaking phase testing.

Preferably said method comprises switching out said second stage amplifier.

In a fifth aspect the invention provides a continuous inkjet printer operable to execute prints with gaps there-between and to undertake phase testing between prints, the printer comprising first and second stage amplifiers operable to amplify charges measured during phase testing, wherein the printer further comprises a controller operable to switch out at least one of the amplifiers between phase tests.

Where the at least one of the amplifiers includes a capacitor in its feedback circuit, the printer of the fifth aspect of the invention makes possible a shorter inter-message gap because the capacitor does not need to be discharged before phase testing.

Preferably the controller is operable to switch out the second stage amplifier.

In a sixth aspect the invention provides a continuous inkjet printer including a system clock; a field programmable gate array (FPGA); and having a printing state, a phase measuring state and a phase test method; said printer being characterized in that said FPGA is configured to receive an input from said system clock and to control the onset of both said printing state and said phase measuring state; and to control said phase test method.

Preferably said FPGA is configured to initiate measures comprising part of said phase test method following a predetermined number of pulses of said system clock after an end of said printing state.

In a seventh aspect the invention provides a method of undertaking a phase test for a continuous inkjet printer configured to execute a sequence of prints wherein as an initial step, the charges on phase test droplets are measured at n positions and wherein a threshold is established so that the charges on droplets at some of the n positions are grouped, lie above the threshold, and are termed 'passes' while the charges on droplets at the remaining positions lie below the threshold and are termed 'fails'; and an initial print position is established being at or near to the middle of the pass positions, wherein between prints test charges are measured at a defined number of phase test positions and specified passes or fails.

Preferably the threshold is established so that the charges on droplets at n/2 positions are grouped, lie above the threshold, and are termed 'passes' while the charges on droplets at the remaining n/2 positions lie below the threshold and are termed 'fails'.

Preferably said defined number of phase test positions are determined relative to said initial print position.

Preferably said defined number of phase test positions comprises three phase test positions.

Preferably the pass or fail statuses at the defined number of phase test positions are compared with data held in memory to determine if a change in print position would enhance print quality.

In an eighth aspect the invention provides a method of reducing the inter-message gap in a continuous inkjet printer executing prints with gaps therebetween, wherein an initial phase test is undertaken on start-up to determine passes and fails at a sequence of phase test positions and wherein an initial print position is established being the position at which a pass charge is the greatest; and wherein phase test measures are subsequently undertaken between prints, said method being characterized in that a defined number of measures are made in a test, each being categorized a pass or a fail, and a combination of passes and fails is used to determine an optimum print position.

Preferably said defined number of measures comprises three measures.

Preferably said method comprises comparing a measured pattern of passes and fails with a table of passes and fails, and print positions, held in a memory.

In a ninth aspect the invention provides a continuous inkjet printer operable to execute prints with gaps therebetween and to undertake an initial phase test on start-up to determine passes and fails at a sequence of phase test positions and establish an initial print position at which a pass charge is the greatest, wherein the printer is operable to undertake phase test measures between prints, by testing at a defined number of phase test positions, categorising each as a pass or a fail, and determining from a resulting combination of passes and fails an optimum print position.

Preferably the defined number of phase test positions is three.

The printer may advantageously include a memory and be operable to compare the resulting combination of passes and fails with a table of passes and fails, and print positions, held in the memory, to determine the optimum print position.

Many variations in the way the invention may be performed will present themselves to those skilled in the art upon reading the following description. The description which follows should not be regarded as limiting but rather, as an illustration only of one mode of performing the invention. Where possible, a description of any element or component should be taken as including any or all equivalents thereof whether or not specifically mentioned.

BRIEF DESCRIPTION OF THE DRAWINGS

The various aspects of the invention will now be described with reference to the accompanying drawings in which:

FIG. 5: shows a table outlining scenarios when a preferred phase setting method as described herein is used.

DETAILED DESCRIPTION OF WORKING EMBODIMENT

Figure 1:
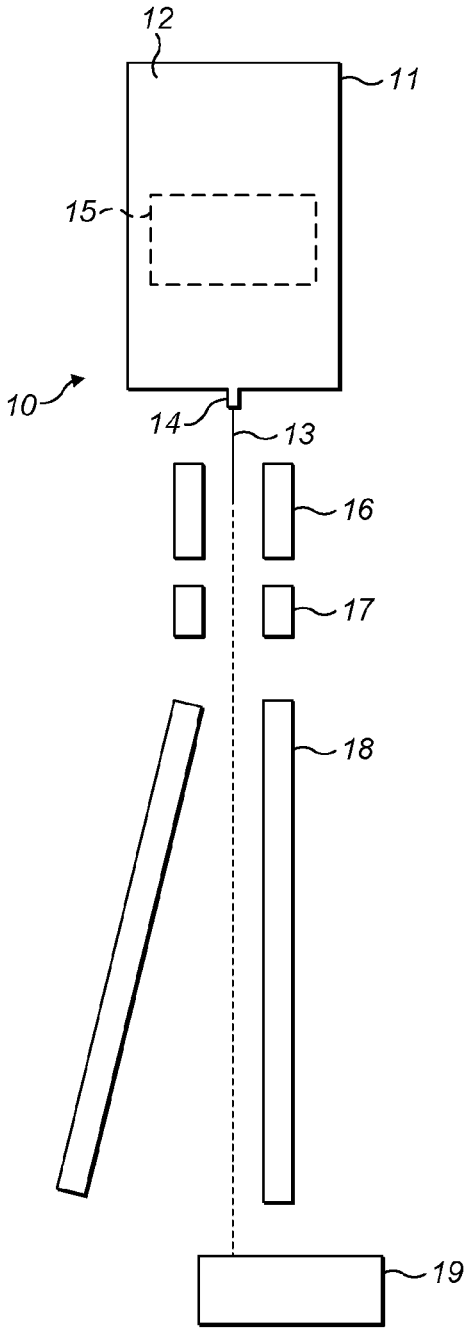
FIG. 1: shows a diagrammatic view of a CIJ printhead.

A typical CIJ printhead 10 is shown in FIG. 1. Ink is fed under pressure into a chamber 12 of droplet generator 11, from which it emerges as a jet 13 from a small outlet nozzle 14. The droplet generator further includes an electromechanical transducer such as a piezoelectric transducer assembly shown schematically at 15. The assembly 15 may be located within the chamber 12 or externally thereof.

Downstream of the nozzle 14 are located a charge electrode or pair of charge electrodes 16 and a phase detection electrode or pair of phase detection electrodes 17 that are arranged so as to be either side of and close to the jet 13.

Typically, the two electrodes or sets of electrodes are placed within 500 microns of the jet and, for simplicity and accuracy of alignment, are preferably embodied in a single assembly.

The printhead 10 further comprises a pair of charged deflector plates 18 configured to generate a static electric field therebetween; and a catcher or gutter 19 to collect unprinted droplets.

In operation a sinusoidal electrical drive signal, commonly referred to as the modulation signal, is applied to the electro mechanical transducer 15. The frequency of the sine wave is chosen to match the nozzle size and jetting speed as defined by the physics of Rayleigh instability, to cause the jet 13 to break into a stream of droplets. For example, a frequency of around 80 kHz applied to ink jetted through a 60 micron nozzle at 20 m/s should lead to the formation of droplets from the jet 13.

In normal operation, when modulation is applied, droplets form within the charge electrode 16. Those droplets that are to be printed are charged by applying a square electrical pulse to the charge electrode, which is the full width of the period of the modulation signal. The charged droplets fly past the phase detection electrodes 17 and are deflected by the electric field between the charged deflector plates 18. Charges are applied to selected droplets to form the strokes required to print a character subject to a minimum charge value being necessary to deflect a droplet past the gutter or catcher 19.

Phase testing is undertaken between prints and, given that CIJ printers print in strokes, phase testing can be undertaken between the last stroke of one message and the first stroke of the next message or, depending on the rate at which strokes are printed, between strokes within a message.

In order to conduct a phase test, the printer applies a potential to the charge electrode for half the length of the time period of the modulation drive frequency. The phasing droplets are charged with a small voltage that is preferably of opposite sign to that used to print. The net effect on the droplets of this charging is that the phasing droplets are deflected in the opposite direction to the printed droplets but, as the charge voltage is small, the charge on the droplets is also small resulting in the phasing droplets still being caught in the ink gutter 19.

Figure 2A:
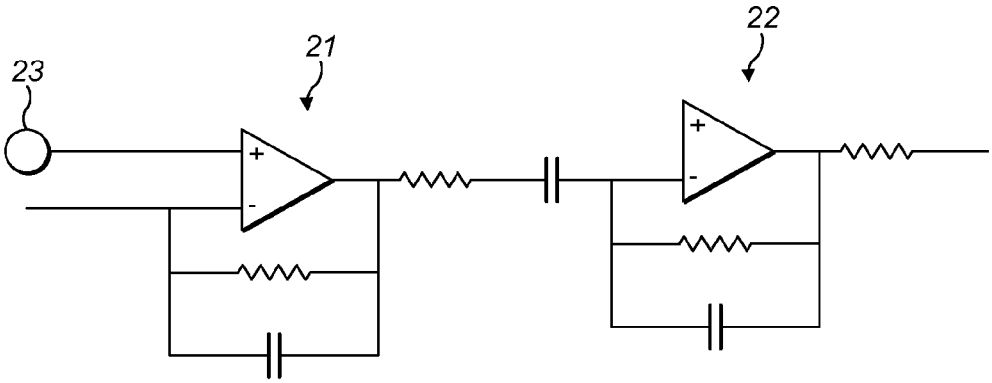
FIG. 2A (Prior Art)
FIG. 2A: shows a prior art phasing circuit incorporated in a CIJ printhead.

As the charges on the phasing droplets are small the printer employs a high gain circuit in order to amplify the signals generated by the droplets as they pass the phase detector 17. Such a circuit, common in prior art CIJ printers such as the Domino A-Series printer, is shown in FIG. 2A and comprises two operational amplifiers 21 and 22 configured to run as ac coupled differentiators. Device values in the feedback loop of the inverting input are chosen to achieve gains of around 100. The phase detector 17 is connected to the non-inverting input 23 of the first amplification stage. Even with this high gain it is often not possible to detect a single droplet and thus a packet of eight or more droplets are typically charged to aid detection.

The phase detector 17 is a simple device, normally consisting of a shielded electrode, and is not able to discriminate between the printed droplets and the droplets used for phase tests. In the prior art case, the circuit is kept active at all times and, when a printed droplet passes the detector, the amplifiers 21 and 22 apply gain, charging the capacitor in the feedback loop. It is thus possible for the capacitor to become fully charged, particularly in the second stage 22 compromising the performance of the amplifiers and making them less responsive, or even unresponsive. As a consequence it becomes necessary to wait for the capacitor to be discharged so that the operational amplifiers 21 and 22 perform as designed when a phasing pulse is applied. Typically, the discharge time could be 500 us or as long as 1 ms. The long discharge time of the capacitor is a consequence of the high gain required by the circuit in order for the charge on the phasing droplets to be detected.

Figure 2B:
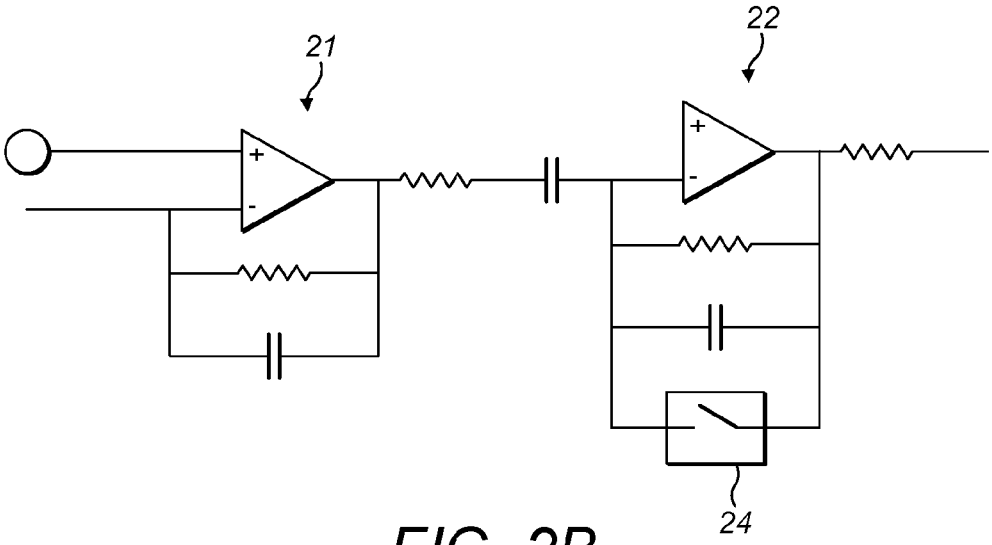
FIG. 2B: shows a phasing circuit for a CIJ printer adapted in accordance with an aspect of the invention.

Accordingly, in another aspect of the invention that can be understood with reference to FIG. 2B, a solution to the problem of discharging the capacitor is provided. A controllable switch 24, controlled for example by a field-programmable gate array device (FPGA), is inserted into the feedback loop of the second amplification stage 22. During normal operation when the printer is printing, the switch is shut. Shutting the switch rapidly removes any residual charge on the capacitor and as it is short circuited by the switch it prevents the capacitor from being recharged. The amplification stage then simply acts as a follower with unity gain. It should be clear that the switch could be placed in the feedback loop of either or both of the amplifiers but clearly the greater benefit is derived when the switch is placed in the feedback loop of the second stage amplifier 22.

Controlling the charge electrode, and hence the charging of the droplets for printing and phase tests using an FPGA, has significant benefits in reducing the time between prints whilst still allowing for a phase test to be performed. In existing art a device such as an FPGA has routines which are called by the system software. The system software has no knowledge of the clock which drives droplet formation and has its own task priority and execution times which, of necessity, limits print speed.

It is desirable for a CIJ printer to measure the phase position at any time it is not printing. Accordingly, if an FPGA as opposed to system software controls all aspects of charge control, the initiation of a phase test period can be considered deterministic when based on the next available droplet once the last printed droplet has passed the sensor 17. In such an embodiment the FPGA is synced to the master clock of the printer and can thus count pulses and implement a phase test measurement after n pulses. In other words the FPGA can count a number of droplets (cycles of the master clock) and determine, following the end of a print, which is the first droplet that can be used for a phase test measurement. So rather than the printer system software executing various routines and then starting a phase test at the next available droplet when phase test has reached the top of the list against a number of competing threads in the software, the FPGA determines exactly when a phase test can start as determined by the exact availability of a droplet for charging after n charge periods.

Figure 3:
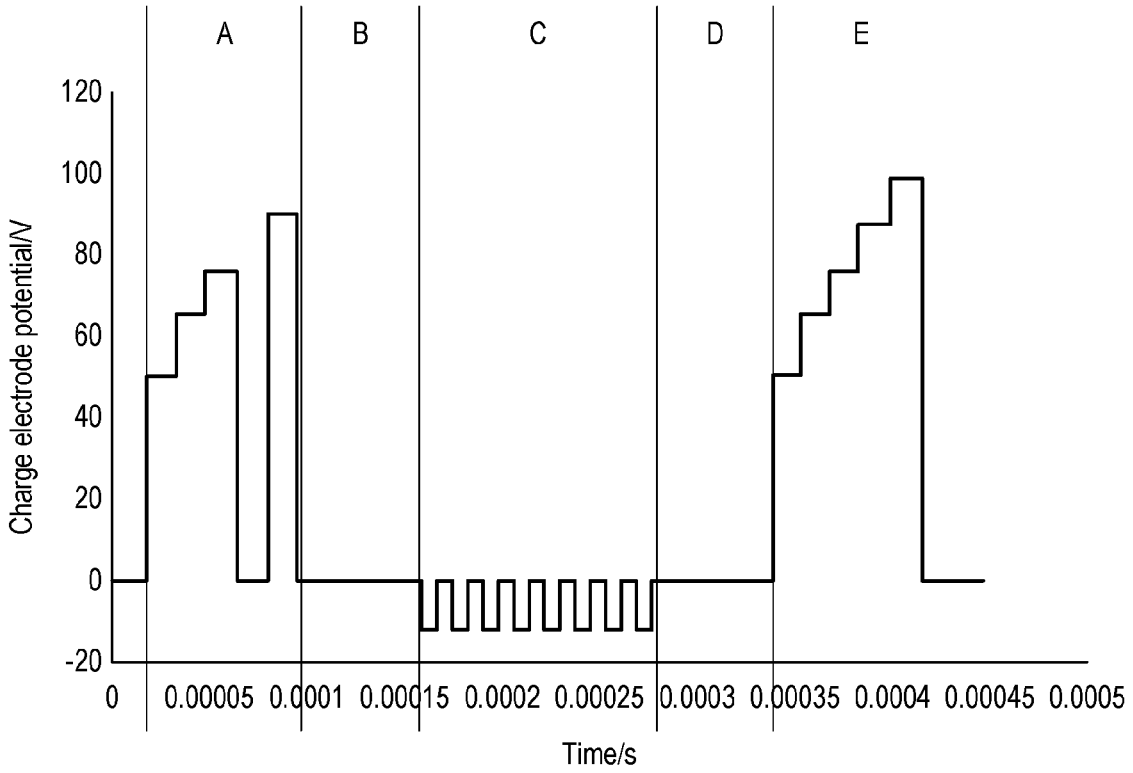
FIG. 3: shows a timing diagram for phase tests between CIJ prints undertaken at high speed.

FIG. 3 illustrates a typical charging scheme as a function of time for a printer printing codes 5 droplets high. In section A, the last stroke of a printed message is shown, printing vertically 3 droplets, followed by a non-printed droplet and a further printed droplet in the top position. In section B, the printer waits a pre-determined time for the highly charged printing droplets to pass the sensor 17. The wait time may be pre-determined by experiment generally for a range of inks and pressure conditions and stored in a look up table, or by the printer by using the time taken between charging a phasing droplet and detecting it at the last phase test. Once the pre-determined time has passed, the FPGA will start charging phase test droplets as shown in section C. The FPGA will also open the switch 24 to increase the gain of the phasing detection circuit shown in FIG. 2B. The increased gain can be switched concomitantly with the charging of the phasing droplet or at the predetermined time defined for section B after the charging of the droplet. Once all phasing droples in the packet are charged there is another wait, illustrated as section D, which is equal to the predetermined time from section B or until the sensor has detected that the droplets have passed the sensor. At this point, i.e. the transition between section D and section E, the switch 24 is closed so that the gain of the detection circuit is lowered.

The printer can either make another phase test or print if a print-go instruction is received, a print-go instruction generally taking priority over a phasing operation. In the example of FIG. 3, a print-go instruction has been received and in section E the printer is printing the first stroke of the next printed message. As illustrated in FIG. 3, the inter-message gap is B+C+D. In this way the printer can make optimum use of every droplet produced in the stream whether it is for printing, for phasing, or is a droplet not used whilst the last printed droplet passes the sensor 17; and the time between prints for a phase measurement to be made can therefore be minimised.

In yet a further aspect of the invention a novel phasing method is proposed to reduce or minimise the number of measures comprising a phase test and to ensure that an optimum phase position is achieved, from a finite number of phase measures, to charge a droplet for printing.

Figure 4:
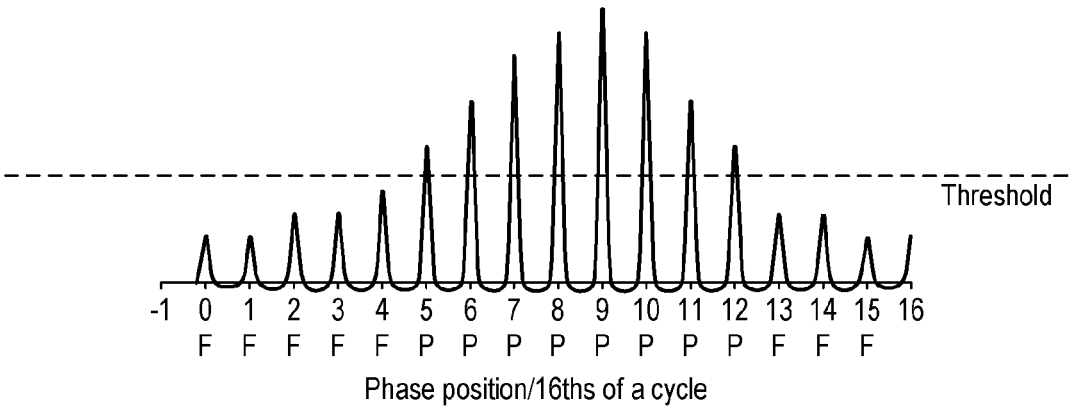
FIG. 4: shows typical results of signal charge level against phase position for a CIJ printer.

Typically, upon start up, a CIJ printer will follow a number of initiation routines. One such routine is to determine the best phase position for printing. Once a drive level for the electromechanical transducer 15 has been determined, the printer carries out a number of measures to establish the amount of charge on phase test droplets at all of then phase positions available to the printer. Referring to FIG. 4, the number (n) of available phase test positions is 16 and a typical response when stepping through the 16 phase positions is illustrated, the response comprising charge amplitudes as measured by the phase sensor 17 from a packet of droplets charged with a half-width pulse. In the case of FIG. 4, which shows the results from such a set of measures, the optimum position for printing is 9/16 of a modulation cycle advanced from the signal used to drive the electromechanical transducer 15, i.e. the position where most charge is transferred to a droplet. As phase measurements involve very small amounts of charge and high gain, there is a large error to the measurement and so preferably the phase signal measurement from a test is compared to a threshold value. If the measured charge level is higher than the threshold this is deemed a pass (P) and if lower than the threshold value this is deemed a fail (F). The threshold value may be pre-determined, for example by experiment, and designed into the printer at a fixed level; but is preferably determined by the electronics and software systems choosing a value that will result in a 50:50 split between passes and fails for all phase tests, thereby choosing the threshold value dynamically.

When the phase measurements are sorted into passes and fails it can be seen that the passes and fails are in contiguous phase positions, with the maximum value falling in the centre of the contiguous blocks of passes. As an initiation process, the printer therefore performs a phase measurement at all possible positions and determines whether the measurement for each individual position is deemed a pass or a fail. When all measurements comprised in a phase test have been collected the printing phase position is set at the centre position of the contiguous block of passes and this is referred to below as the initial print position.

Those skilled in the art will realise that, for closely spaced high-speed printing applications, there is not time to perform the 16 measurements needed to determine which of the 16 phase steps gives the highest measured charge output. As the threshold value between pass and fail has been set so that 50% of the phase positions deliver a pass then it follows that the optimum position for printing lies four phase steps in front of the transition point between pass and fail.

Leading on from this, one known method to determine the best phase position between prints is to start at the initial print position, increment the phase position by one and perform a test measure, continue to increment the phase position by one until the first failure is observed, and then step back four positions. As can be seen in FIG. 4, if we have selected the initial print position to be 9, the first test measure will be at position 10 and will be a pass, the second test measure will be at position 11 and will be a pass, the third test measure will be at position 12 and will be a pass and the fourth test measure will be at position 13 and a fail. We would then step back four positions to position 9 and set this for printing. This method is much faster as it only takes four test measures but is still too long for closely spaced high-speed printing applications.

Another known method involves, as an initial step, moving forward four phase positions and performing a test measure, stepping forward if the result is a pass and backward if the result is a fail. Once pass and fail are found in contiguous positions the print set point is four steps retarded from this transition point. So again looking at the case illustrated in FIG. 4, we would start at position 9 then step forward 4 to position 13, which would register as a fail. The test position would be retarded one place and tested at position 12, which would be measured as a pass, the pass to fail transition thus occurs at position 13, which would lead to the set position being retarded four steps to position 9. This method is again much faster but takes at least two tests and, apart from perhaps being too long for closely spaced high-speed printing applications, this method also has the problem that an indeterminate number of tests is required if the best printing position has shifted between prints. For example, if the phase pattern has shifted two steps earlier to position 7, then the transition point will be between positions 10 and 11 and, following the stated methodology, the printer will test at position 13 and find a failure, then at 12 and find a failure, then at 11 and find a failure, and finally at 10, before stepping back to position 7. Such a case would take 4 tests, and in the case of a closely spaced high speed printing application would mean, in practice, that the printer would never reach the end of its phase test resulting in degraded print quality from the printer.

To overcome the above problems, another aspect of this invention proposes a novel phase testing method in which a single phase test measure is made between prints and a combination of the results of the measures, which comprises a phase test, is then used as the basis of a decision of whether it is necessary or beneficial to change the print position. In the illustrated example, three measures are combined to form a phase test.

According to the proposed method in three consecutive measures the phase position is stepped forward two positions for a pass and one position back for a fail, the results being recorded in a look-up table. An assessment of whether a change is necessary is made after every third measurement according to a predetermined set of data in the table.

Assuming again that the printer is set at an initial print position, position 9, and has a phase position as presented in FIG. 4, we find a first test measure at position 11 which is recorded as a pass, a second test measure at 13, which is recorded as a fail and a third test measure at 12, which is recorded as a pass. The resulting PFP combination is then compared with the data in the look-up table illustrated in FIG. 5, indicating that the printer needs to retard three steps from the last measurement, thus setting at position 9.

The table in FIG. 5 displays all of the possible outcomes of phase tests where the phasing window has drifted between prints. At the last successful phase test the printer had chosen position 9, which for all scenarios is then the initial print position. At line two of the table a situation is illustrated in which the best printing position has moved down one to position 8. In line with this change, the phasing window has also moved so that passes are found between positions 4 and 11, whereas before the phase pass window was positioned between 5 and 12. The table shows the result and steps taken for the three tests and the action resulting from the test pattern.

The resulting actions shown in FIG. 5 have been chosen to ensure consistency and the best result for print quality. It is realised that, as there are eight pass positions then, as far as the system is concerned, there are effectively two central positions and the choice depends on whether the high edge transition or the low edge transition has been found. Accordingly, the objective is to let the printer choose the best printing position within an error margin of one phase step. The table in FIG. 5 shows that this is achieved on all but four of the sixteen possible scenarios. A further benefit is that the method sets the printer to a closer point to the best printing position after three tests so that if the entire method were used twice the printer would arrive at the optimum setting.

The result of using the novel method outlined above is that it is possible to monitor and control a continuous inkjet printer even if it is printing in the demanding application where prints take place on closely spaced substrates at high speed. The system can cope with gross changes in phase position, returning the printer to a near optimised phase position generally within three measurements and certainly within six measurements. Normally a printer will drift quite slowly with respect to the modulation frequency but can drift by one or two steps.

The invention claimed is:

1. A method of controlling a continuous inkjet printer configured to execute prints with gaps there-between and to undertake phase testing between said prints, said printer comprising an amplifier configured to amplify charges measured during phase testing wherein the amplifier comprises a first stage amplifier and a second stage amplifier configured to run as ac coupled differentiators, said method comprising switching out at least one of said amplifiers when said printer is not undertaking phase testing.

2. The method of claim 1 further comprising switching out the second stage amplifier.

3. A continuous inkjet printer operable to execute prints with gaps there-between and to undertake phase testing between prints, the printer comprising an amplifier operable to amplify charges measured during phase testing, wherein the amplifier comprises first and second stage amplifiers configured to run as ac coupled differentiators, the printer further comprising a controller operable to switch out at least one of the amplifiers between phase tests.

4. The continuous inkjet printer of claim 3, wherein the controller is operable to switch out the second stage amplifier.

* * * * *